US012690737B2

(12) United States Patent
Lee

(10) Patent No.: US 12,690,737 B2
(45) Date of Patent: Jul. 28, 2026

(54) CLEANING ROBOT

(71) Applicant: SAMSUNG ELECTRONICS CO., LTD., Suwon-si (KR)

(72) Inventor: Hakbong Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 726 days.

(21) Appl. No.: 17/949,295

(22) Filed: Sep. 21, 2022

(65) Prior Publication Data

US 2023/0233046 A1 Jul. 27, 2023

Related U.S. Application Data

(63) Continuation of application No. PCT/KR2022/013564, filed on Sep. 8, 2022.

(30) Foreign Application Priority Data

Jan. 26, 2022 (KR) ..... 10-2022-0011790

(51) Int. Cl.
*A47L 11/28* (2006.01)
*A47L 11/283* (2006.01)
*A47L 11/40* (2006.01)

(52) U.S. Cl.
CPC ..... *A47L 11/283* (2013.01); *A47L 11/4038* (2013.01); *A47L 11/4069* (2013.01);
(Continued)

(58) Field of Classification Search
CPC ..... A47L 11/283; A47L 11/4038; A47L 11/4069; A47L 11/4072; A47L 11/4083;
(Continued)

(56) References Cited

U.S. PATENT DOCUMENTS 5,849,097 A * 12/1998 Windmeisser ..... A47L 11/4038 15/49.1
10,874,271 B2 * 12/2020 Kastensson ..... A47L 11/4038
(Continued)

FOREIGN PATENT DOCUMENTS

CN 108852184 A 11/2018
CN 111000494 A 4/2020
(Continued)

OTHER PUBLICATIONS

International Search Report, PCT/ISA/210, in International Application No. PCT/KR2022/013564, dated Dec. 22, 2022.
(Continued)

*Primary Examiner* — Katina N. Henson
(74) *Attorney, Agent, or Firm* — STAAS & HALSEY LLP

(57) ABSTRACT

A cleaning robot includes a main body having an exterior portion extending along a perimeter of the main body; wheels that are drivable to move the robot; a rotation shaft; and a holder coupled to the rotation shaft to support a cleaning pad. The rotation shaft and the holder are rotatable along a rotation axis that is perpendicular to the surface to be cleaned, and the rotation shaft is laterally movable in a direction perpendicular to the rotation axis to: a pop-in position in which the rotation shaft and the holder are under the main body and not protruding beyond the exterior portion of the main body, and a pop-out position in which the rotation shaft is under the main body and not protruding beyond the exterior portion and the holder is partially under the main body and partially protruding beyond the exterior portion of the main body.

19 Claims, 8 Drawing Sheets

(52) U.S. Cl.
CPC ..... *A47L 11/4072* (2013.01); *A47L 11/4083* (2013.01); *A47L 2201/06* (2013.01)

(58) Field of Classification Search
CPC .. A47L 2201/06; A47L 11/40; A47L 11/4011; A47L 11/4066; A47L 11/4061; A47L 2201/04
USPC ..... 15/61
See application file for complete search history.

(56) References Cited

U.S. PATENT DOCUMENTS

| | | | | |
|---|---|---|---|---|
| 11,432,695 | B2 | 9/2022 | Jang et al. | |
| 2006/0185690 | A1* | 8/2006 | Song | A47L 11/34 134/21 |
| 2013/0098402 | A1* | 4/2013 | Yoon | A47L 11/4069 15/3 |
| 2013/0152332 | A1 | 6/2013 | Jang | |
| 2013/0291331 | A1 | 11/2013 | Yang et al. | |
| 2014/0130289 | A1* | 5/2014 | Hyun | A47L 11/185 15/319 |
| 2017/0049289 | A1 | 2/2017 | Ichikawa et al. | |
| 2019/0038101 | A1 | 2/2019 | Jang | |
| 2019/0191952 | A1* | 6/2019 | Johnson | A47L 11/4011 |
| 2020/0253445 | A1* | 8/2020 | So | A47L 9/0411 |
| 2021/0093144 | A1 | 4/2021 | Shin et al. | |
| 2021/0093145 | A1 | 4/2021 | Kim et al. | |

FOREIGN PATENT DOCUMENTS

| | | | | | |
|---|---|---|---|---|---|
| CN | 112690703 | A | | 4/2021 | |
| CN | 113425201 | A | * | 9/2021 | A47L 11/4069 |
| EP | 1222892 | A1 | * | 7/2002 | A47L 9/02 |
| EP | 2 583 609 | A2 | | 4/2013 | |
| EP | 3 664 681 | | | 2/2019 | |
| JP | 7-32751 | | | 4/1995 | |
| JP | 2006-87508 | A | | 4/2006 | |
| JP | 5243879 | | | 7/2013 | |
| JP | 5410067 | B2 | | 11/2013 | |
| JP | 6857803 | | | 4/2021 | |
| KR | 10-2007-0107956 | | | 11/2007 | |
| KR | 10-2012-0088314 | A | | 8/2012 | |
| KR | 10-1352170 | | | 1/2014 | |
| KR | 10-2016-0092395 | A | | 8/2016 | |
| KR | 10-1735920 | B1 | | 5/2017 | |
| KR | 10-1857295 | | | 5/2018 | |
| KR | 10-1892652 | | | 8/2018 | |
| KR | 10-1931360 | | | 12/2018 | |
| KR | 10-2021828 | B1 | | 9/2019 | |
| KR | 10-2021-0015597 | A | | 2/2021 | |
| KR | 10-2021-0036736 | A | | 4/2021 | |
| KR | 10-2021-0037064 | A | | 4/2021 | |

OTHER PUBLICATIONS

European Search Report dated Feb. 3, 2025 issued in EP 22 92 4308.
Office Action dated Nov. 26, 2026, in European Application No. 22 924 308.4.

* cited by examiner

CLEANING ROBOT

CROSS REFERENCE TO RELATED APPLICATIONS

This application is a continuation application, under 35 U.S.C. § 111(a), of International Application No. PCT/KR2022/013564, filed on Sep. 8, 2022, which claims priority to Korean Patent Application No. 10-2022-0011790, filed on Jan. 26, 2022, in the Korean Intellectual Property Office, the disclosures of which are incorporated by reference herein in their entireties.

BACKGROUND

1. Field

The disclosure relates to a cleaning robot.

2. Description of Related Art

A cleaning robot is an electronic device which carries out cleaning by driving by itself in an interior space to be cleaned. The cleaning robot may generate a map showing a structure of an interior space or obstacles therein to perform preset operations, such as cleaning, etc., and may drive in the interior space based on the generated map and perform a cleaning operation.

The cleaning robot may include a cleaning pad to wipe a floor. To wipe a floor adjacent to obstacles, walls, etc., the cleaning pad may be designed to protrude from a main body of the cleaning robot. Due to the protruding cleaning pad, the outermost exterior of the cleaning robot may be greater than the main body of the cleaning robot. The possibility of interference by obstacles during the driving of the cleaning robot may increase as the outermost exterior of the cleaning robot increases. In addition, as the cleaning robot cannot pass through any crack narrower than the width of the outermost exterior of the cleaning robot, it is difficult for the cleaning robot to clean such cracks.

SUMMARY

A cleaning robot according to an embodiment of the disclosure may include a main body, wheels, a first shaft, and a first holder. The main body has an exterior portion extending along a perimeter of the main body. The wheels are drivable to move the cleaning robot on a surface to be cleaned. The first holder is coupled to the first rotation shaft and configured to support a first cleaning pad. Wherein the first rotation shaft and the first holder are configured so that, when the cleaning robot is on the surface to be cleaned and the first cleaning pad is supported by the first holder: the first rotation shaft is rotatable along a rotation axis that is perpendicular to the surface to be cleaned to cause the first holder to rotate and thereby rotate the first cleaning pad to clean the surface, and the first rotation shaft is laterally movable in a direction perpendicular to the rotation axis to: a pop-in position in which the first rotation shaft and the first holder are under the main body and not protruding beyond the exterior portion of the main body, and a pop-out position in which the first rotation shaft is under the main body and not protruding beyond the exterior portion and the first holder is partially under the main body and partially protruding beyond the exterior portion of the main body.

A cleaning robot according to an embodiment of the disclosure may include: a main body including an exterior portion of a circular shape; a pair of driving wheels on a first center line at a bottom portion of the main body; and a movable cleaning portion in front of the pair of driving wheels. The movable cleaning portion includes: a first holder configured to support a first cleaning pad, a frame rotatably supporting the first holder, a first motor configured to rotate the first holder and first cleaning pad. A second holder is configured to support a second cleaning pad and is symmetrical with the first holder with respect to a second center line perpendicular to the first center line. The frame is supported by the main body to allow a straight movement of the first holder to: a pop-in position in which the first holder is under the main body and not protruding beyond the exterior portion of the main body, and a pop-out position in which the first holder is partially under the main body and partially protruding beyond the exterior portion of the main body.

BRIEF DESCRIPTION OF THE DRAWINGS

Aspects, features, and advantages of certain embodiments of the present disclosure will be more apparent from the following description taken in conjunction with the accompanying drawings, in which.

DETAILED DESCRIPTION

Figure 1:
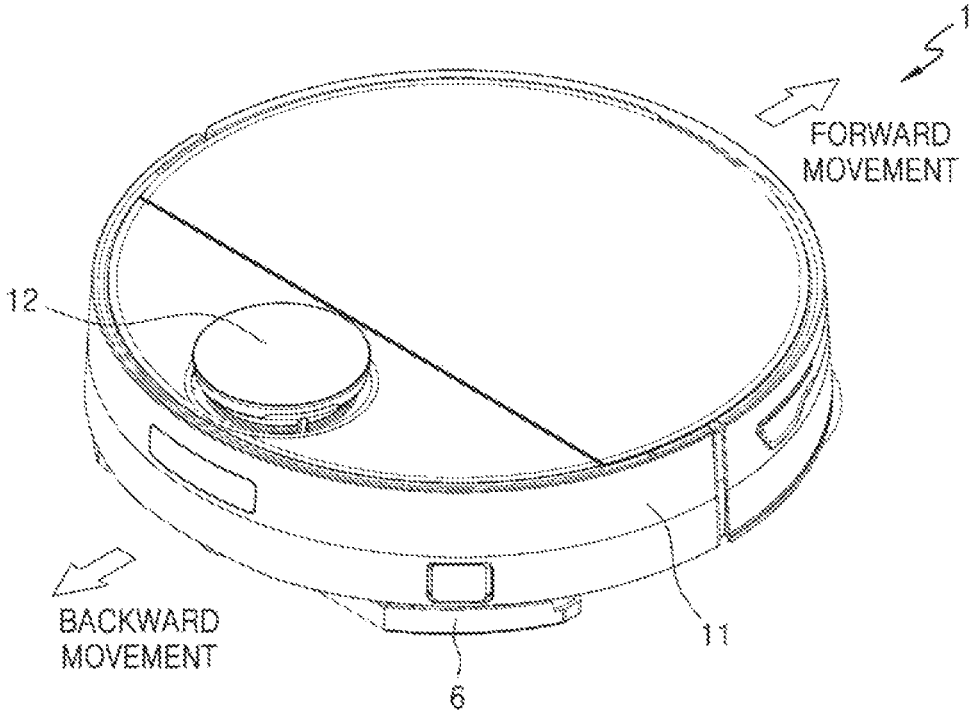
FIG. 1 is a schematic perspective view of a cleaning robot according to an embodiment of the disclosure and illustrates a state in which a first cleaning pad assembly is placed in a pop-in position.

Throughout the disclosure, the expression "at least one of a, b or c" indicates only a, only b, only c, both a and b, both a and c, both b and c, all of a, b, and c, or variations thereof.

General terms which are currently used widely have been selected for use in consideration of their functions in embodiments of the disclosure; however, such terms may be changed according to an intention of a person skilled in the art, precedents, advent of new technologies, etc. Furthermore, in certain cases, terms have been arbitrarily selected by the applicant, and in such cases, meanings of the terms will be explained in detail in corresponding descriptions. Accordingly, the terms used in the embodiments of the disclosure should be defined based on their meanings and overall descriptions of the embodiments of the disclosure, not simply by their names.

An expression used in the singular encompasses the expression of the plural, unless it has a clearly different meaning in the context. The terms used herein, including technical or scientific terms, may have the same meaning as commonly understood by one of ordinary skill in the art.

Throughout the specification, when a portion "includes" a component, another component may be further included, rather than excluding the existence of other components, unless otherwise described. In addition, the terms " . . . portion," "module," etc., described in the specification refer to a unit for processing at least one function or operation, which can be implemented by a hardware or a software, or a combination of a hardware and a software.

The expression of "configured to" used herein may be replaced with, for example, "suitable for," "having the capacity to," "designed to," "adopted to," "made to," or "capable of" as applicable. Hardware-wise, the expression "configured to" may not necessarily mean "specifically designed to." Instead, in some cases, the expression "a system configured to . . . " may mean that "a system is capable of . . . together with other devices and parts. For example, the expression "a processor configured to perform A, B, and C" may mean a dedicated processor for performing A, B, and C (e.g., an embedded processor) or a generic-purpose processor (e.g., a central processing unit or an application processor) capable of performing A, B, and C by executing one or more software programs stored in a memory.

In addition, through of the disclosure, when one component is "coupled to" or "connected to" another component, it should be construed as meaning that one component is directly connected to another component or one component is coupled or connected indirectly to another component via an intervening component arranged therebetween unless otherwise described.

Hereinafter, embodiments of the disclosure will be described in detail with reference to the accompanying drawings so that a person with ordinary skill in the art may easily perform the disclosure. However, the disclosure may be implemented in various forms, and are not limited to the embodiments described herein. To clearly describe the disclosure, parts that are not associated with the description have been omitted from the drawings, and throughout the specification, like reference numerals refer to like parts. Hereinafter, embodiments of the disclosure will be described in detail with reference to the accompanying drawings.

A cleaning robot is a robotic device capable of driving by itself in an interior space for cleaning. The interior space may refer to an area in which the cleaning robot may move substantially freely. The interior space may include, for example, an inside space of a house, an office, etc. The disclosure aims to provide a cleaning robot capable of effectively cleaning a floor adjacent to an obstacle. The disclosure also aims to provide a cleaning robot capable of stable driving.

Figure 2:
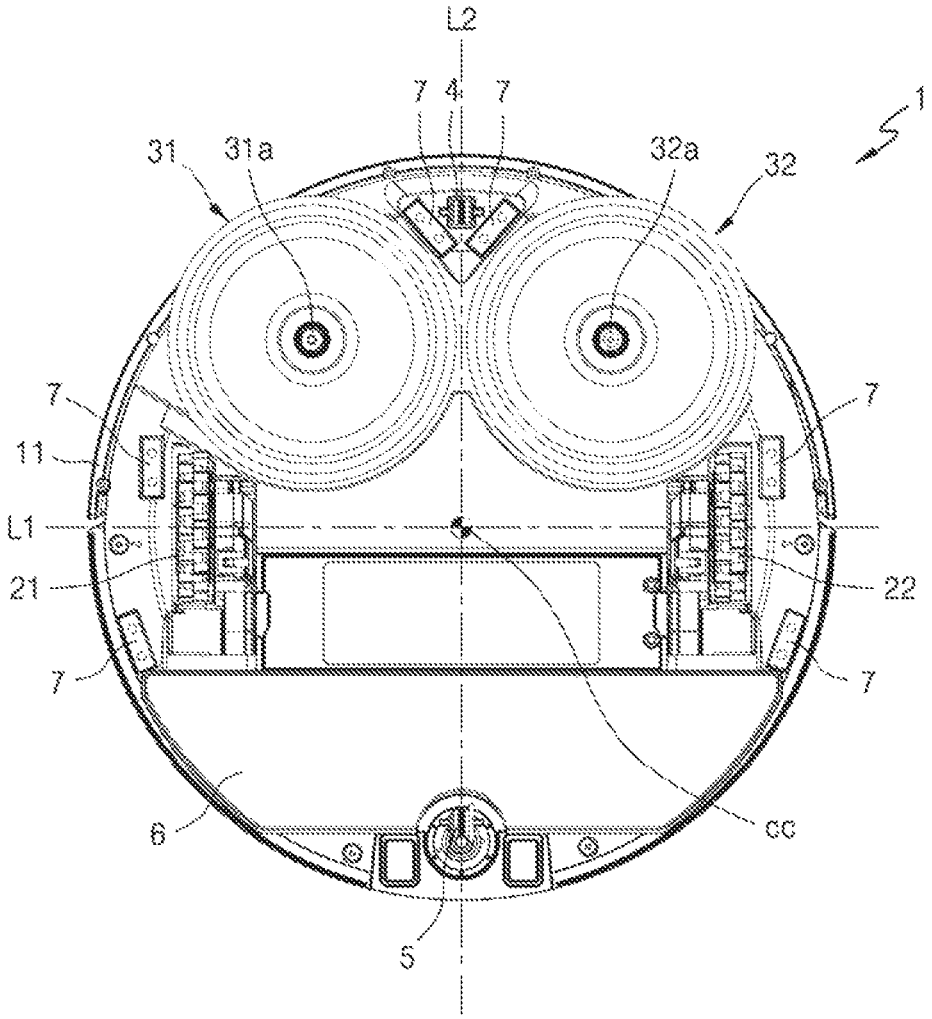
FIG. 2 is a schematic rear view of a cleaning robot according to an embodiment of the disclosure and illustrates a state in which a first cleaning pad assembly is placed in a pop-in position.
Figure 3:
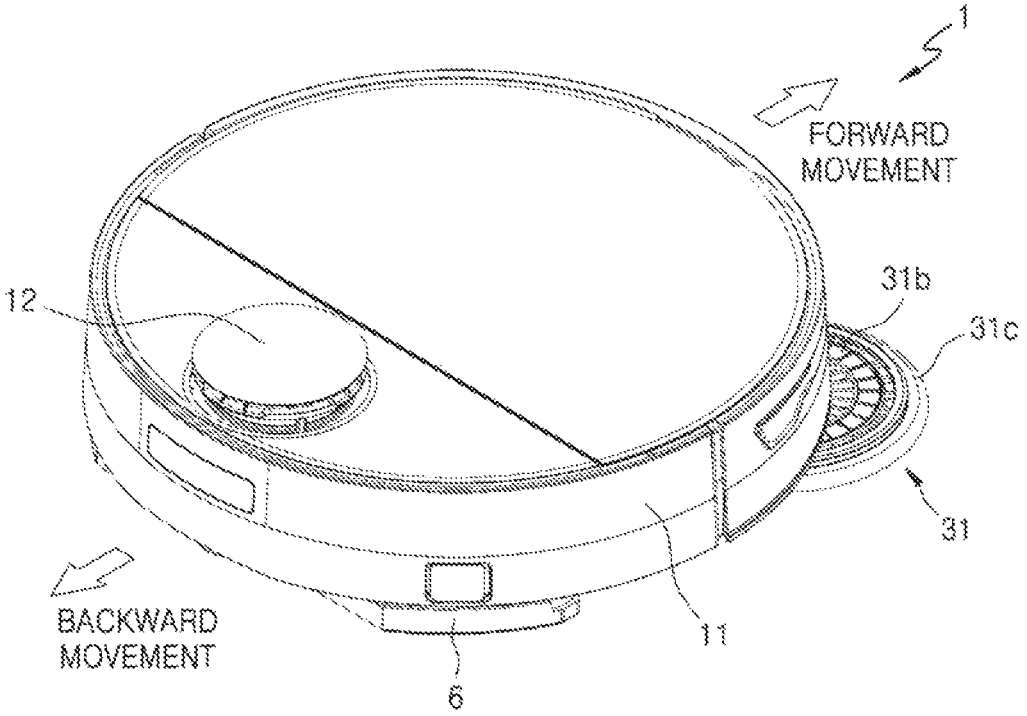
FIG. 3 is a schematic perspective view of a cleaning robot according to an embodiment of the disclosure and illustrates a state in which a first cleaning pad assembly is placed in a pop-out position.
Figure 4:
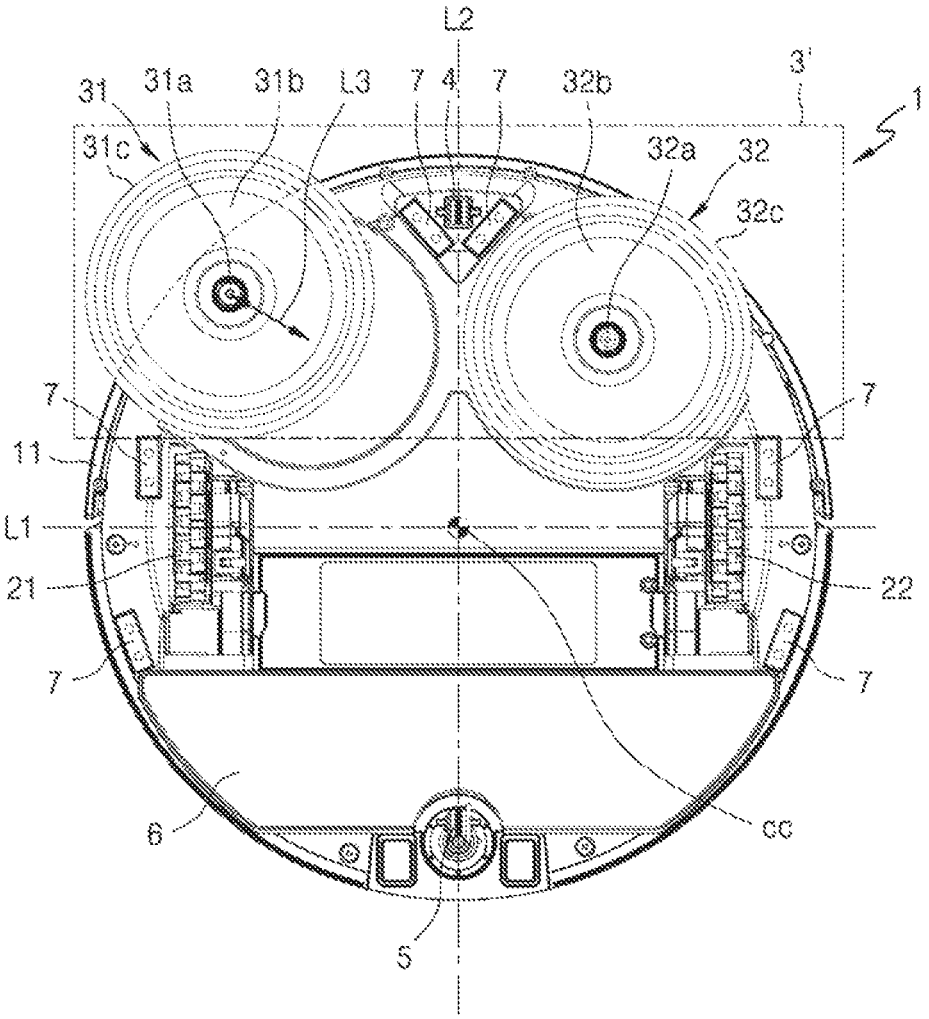
FIG. 4 is a schematic rear view of a cleaning robot according to an embodiment of the disclosure and illustrates a state in which a first cleaning pad assembly is placed in a pop-out position.

FIGS. 1 and 2 are schematic perspective view and rear view of a cleaning robot according to an embodiment of the disclosure, respectively and illustrate a state in which a first cleaning pad is placed in a pop-in position. FIGS. 3 and 4 are schematic perspective view and rear view of a cleaning robot according to an embodiment of the disclosure, respectively and illustrate a state in which a first cleaning pad is placed in a pop-out position. With reference to FIGS. 1 and 2, a cleaning robot according to an embodiment of the disclosure may include a main body 1, a pair of driving wheels 21 and 22, and a first cleaning pad assembly 31.

The main body 1 may have an overall circular shape. The main body 1 may include a housing accommodating various components constituting the cleaning robot. The housing may include an upper housing, a lower housing, and a lateral housing. The lateral housing may be integrated with the upper housing or the lower housing, or may be separate from the upper housing and the lower housing. The main body 1 may include an exterior portion 11 having a circular shape. The main body 1 including the exterior portion 11 having a circular shape may have an advantage in direction change of the cleaning robot. When facing an obstacle, the cleaning robot may perform an avoidance operation, for example, a direction change operation. For example, in case of a cleaning robot including an exterior portion having a tetragonal shape, when the cleaning robot rotates in place, a portion of the exterior portion far from a rotation center may bump into an obstacle. To avoid this, the cleaning device having the tetragonal exterior portion may need to move backward by a certain distance from the obstacle before rotating. According to the cleaning robot including the exterior portion 11 having a circular shape, when the cleaning robot bumps into an obstacle or changes its direction to avoid the obstacle, the cleaning robot may rotate on the spot. Accordingly, stable driving and effective change of direction of the cleaning robot may be possible.

A light detection and ranging (LiDAR) module 12 may be provided on the main body 1. The cleaning robot may explore an interior space by using the LiDAR module 12 and generate a map of the exterior space. To obtain information about the interior space around the main body 1, at least a portion of the LiDAR module 12 may protrude from the main body 1, for example, an upper surface of the main body 1. The LiDAR module 12 may include a LiDAR sensor. The LiDAR sensor may include a light emitting portion configured to irradiate light, e.g., laser, to the outside, and a light receiving portion configured to receive reflected laser. To obtain information of the interior space within 360 degrees based on a position of the cleaning robot, the LiDAR module 12 or the LiDAR sensor may be rotated by a driving motor (not shown) with respect to the main body 1. The cleaning robot may explore the interior space by using the LiDAR sensor and create a map of the interior space by detecting a structure of the interior space and obstacles in the interior space. The LiDAR module 12 may analyze a time difference between emission of laser to the interior space and return of the laser reflected from an object or obstacle in the interior space, and a signal intensity to obtain information about a distance, position, direction, material, etc. of the object or obstacle. The cleaning robot may explore the interior space by using the LiDAR module 12 to obtain geometry information about positions and structures of walls, objects, or obstacles in the interior space.

Figure 5:
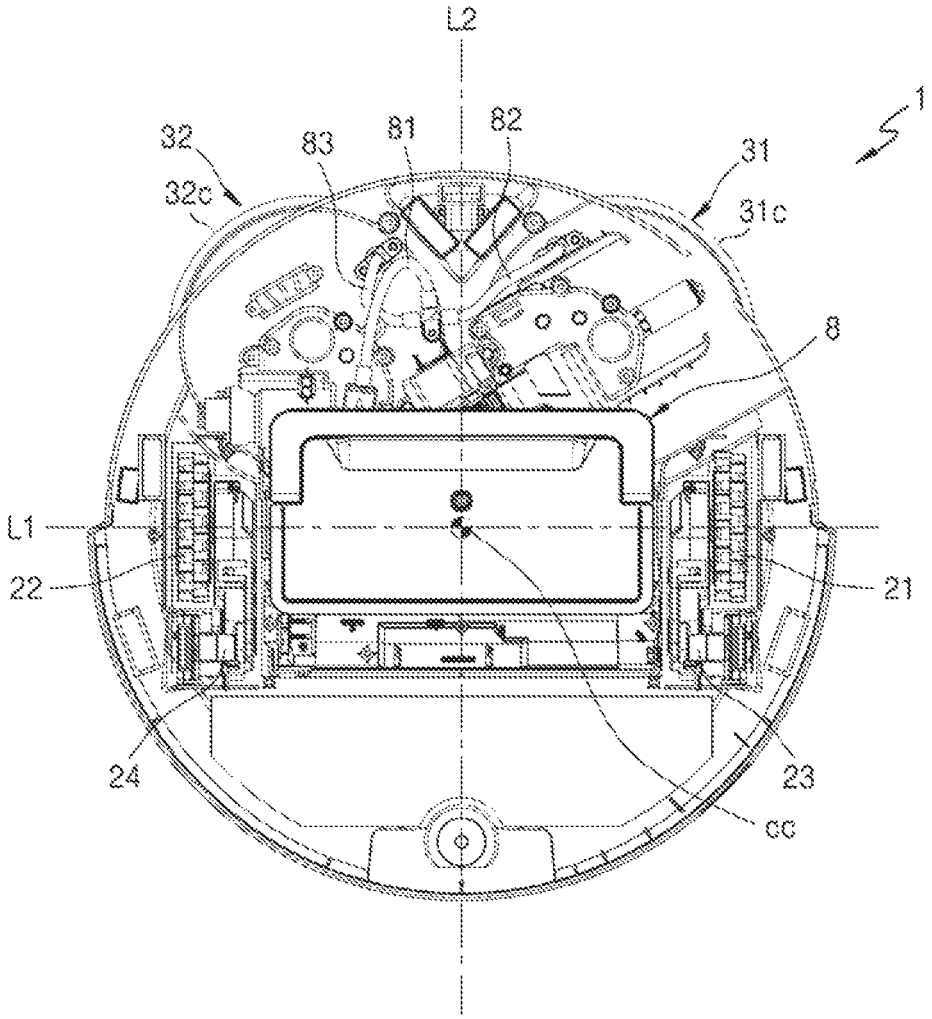
FIG. 5 is a schematic plan view of a cleaning robot according to an embodiment of the disclosure and illustrates a state in which an upper housing of a main body is removed.

The cleaning robot includes wheels that are drivable to move the cleaning robot on a surface to be cleaned. The wheels may include a pair of driving wheels 21 and 22. The pair of driving wheels 21 and 22 may be provided at a bottom portion of the main body 1. The pair of driving wheels 21 and 22 may be arranged in parallel on a first center line L1. The first center line L1 may be a line passing the center of the main body 1. The first center line L1 may be a line perpendicular to a driving direction of the main body 1. The pair of driving wheels 21 and 22 may be arranged symmetrically with respect to the center CC of the main body 1 on the first center line L1. The pair of driving wheels 21 and 22 may drive the cleaning robot. The pair of driving wheels 21 and 22 may be driven by a pair of driving motors 23 and 24 (FIG. 5). According to the combination of rotation speed and rotation direction of the pair of driving wheels 21 and 22, the cleaning robot may perform operations, such as forward movement, backward movement, direction change (rotation), etc. while cleaning.

A structure in which a pair of cleaning pads is arranged at the bottom portion of the main body 1 in a direction perpendicular to the driving direction of the cleaning robot, and the cleaning robot is driven as the pair of cleaning pads rotates may be considered. The friction between the pair of cleaning pads and the floor (surface to be cleaned) may vary depending on the condition of the floor, and accordingly, the cleaning robot may drive in a diagonal direction instead of straight direction when moving forward or backward. Moreover, the cleaning robot may unintentionally rotate. As the driving speed of the cleaning robot is determined by the rotation speed of the pair of cleaning pads, there may be case where the driving condition of the cleaning robot is incompatible with the cleaning capacity condition of the pair of cleaning pads. That is, the cleaning capacity of the pair of cleaning pads may be limited by the driving speed of the cleaning robot.

According to the cleaning robot of the disclosure, the pair of driving wheels 21 and 22 may be employed to drive the cleaning robot. Accordingly, the rotation speed of the first cleaning pad assembly 31 may be controlled independently from the driving speed of the cleaning robot. In this manner, the cleaning robot capable of stable driving and without limitation in cleaning capacity may be implemented.

The first cleaning pad assembly 31 may be provided at the bottom portion of the main body 1. The first cleaning pad assembly 31 may be arranged in front of the pair of driving wheels 21 and 22. The first cleaning pad assembly 31 may include a cleaning pad (first cleaning pad) 31*c* and a holder (first holder) 31*b* supporting the cleaning pad 31*c*. The cleaning pad 31*c* may be a fabric material, for example, a fabric with fur, etc. The shape of the cleaning pad 31*c* may not be limited to certain shapes. In the embodiment of the disclosure, the cleaning pad 31*c* may be a circular fabric pad. The first cleaning pad assembly 31 may be rotated around a rotation shaft (first rotation shaft) 31*a*. The first cleaning pad assembly 31 may wipe the floor of the interior space while rotating around the rotation shaft 31*a*. A structure rotating the first cleaning pad assembly 31 is to be described below. The first cleaning pad assembly 31 may be arranged on one side with respect to a center line of the driving direction, i.e., a second center line L2.

The first cleaning pad assembly 31 may be arranged at the main body 1 movably to a pop-in position under the main body 1 and a pop-out position partially protruding outwards from the main body 1. In the pop-in position, the first holder 31*b* may be arranged under the main body 1 so that the holder 31*b* supporting the cleaning pad 31*c* may not protrude from the exterior portion 11 of the main body 1. In the pop-out position, the holder 31*b* may partially protrude from the exterior portion 11 of the main body 1. A structure moving the first cleaning pad assembly 31 to the pop-in position and the pop-out position is to be described below.

An alternative employing, instead of the first cleaning pad assembly 31, a fixed tetragonal cleaning pad 3' protruding outwards from the main body 1 as shown in dotted line in FIG. 4 may be considered. By using the fixed tetragonal cleaning pad 3', a floor adjacent to obstacles, for example, walls, etc., a crack under an upper obstacle, etc. may be cleaned. However, when rotation of the cleaning robot is needed to avoid an obstacle, the cleaning robot may move backward by a certain distance before rotation such that it does not bump into the obstacle. Moreover, as the width of the fixed tetragonal cleaning pad 3' is greater than the width of the main body 1, a possibility of interference by an obstacle during movement of the cleaning robot may be relatively high, and a space having a narrower width than that of the fixed tetragonal cleaning pad 3', for example, a space between legs of a chair, etc. may not be cleaned as the cleaning robot is unable to pass through such space.

According to cleaning robot of the disclosure, when it is cleaning a wide space, the first cleaning pad assembly 31 may be placed in the pop-in position as illustrated in FIGS. 1 and 2. The first cleaning pad assembly 31 may be placed further inside than the exterior portion 11 of the main body 1. Accordingly, the possibility of interference by an obstacle during the movement of the cleaning robot may be relatively low, and when performing the rotation operation to avoid an obstacle, the cleaning robot may rotate immediately without any backward movement operation. Moreover, the cleaning robot may easily clean a narrow space as long as the width of the space is wider than the width of the main body 1. When the cleaning robot is cleaning a floor adjacent to obstacles, for example, walls, etc., a crack under an upper obstacle, etc., the first cleaning pad assembly 31 may be placed in the pop-out position as illustrated in FIGS. 3 and 4. For example, when a wall or an obstacle is sensed during the driving of the cleaning robot, the first cleaning pad assembly 31 may be moved to the pop-out position as illustrated in FIGS. 3 and 4. The cleaning robot may clean a floor adjacent to an obstacle by driving in a manner allowing the first cleaning pad assembly 31 to follow the obstacle. When the cleaning robot has passed through a space with an obstacle, the first cleaning pad assembly 31 may be moved back to the pop-in position as illustrated in FIGS. 1 and 2. As such, according to the disclosure, the cleaning robot may have a narrow outermost exterior and effectively clean a floor adjacent to an obstacle.

In the pop-out position, there may be no specific limitation on a degree of protrusion of the first cleaning pad assembly 31. In the pop-out position, the degree of protrusion of the first cleaning pad assembly 31 may need to be great enough for the main body 1 to clean a floor adjacent to an obstacle without interference by the obstacle. In the pop-out position, the rotation shaft 31*a* of the first cleaning pad assembly 31 may be arranged inside the main body 1. That is, in the pop-out position, the rotation shaft 31*a* of the first cleaning pad assembly 31 may not protrude from the exterior portion 11 of the main body 1. For example, when first cleaning pad assembly 31 protrudes, placing the rotation shaft 31*a* out of the exterior portion 11 of the main body 1, a support structure supporting the rotation shaft 31*a* may need to be formed up to a position to which the rotation shaft 31*a* protrudes from the exterior portion 11 of the main body 1. Then, the exterior form of the cleaning robot may have a shape in which the support structure protrudes from the exterior portion 11 of the main body 1, and accordingly, the main body 1 of the cleaning robot may not maintain an overall circular shape even in a pop-in state. The cleaning robot having such protruding support structure may have a great radius of rotation to avoid an obstacle, and when the cleaning robot rotates near the obstacles, it may have to move backward first before rotation such that the protruding support structure is not interfered by the obstacle. According to the cleaning robot of the disclosure, as the rotation shaft 31*a* of the first cleaning pad assembly 31 is placed inside the main body 1 in the pop-out position, the exterior portion 11 of the main body 1 may maintain the overall circular shape in the pop-in state, which leads to stable and efficient driving.

The first cleaning pad assembly 31 may be moved to the pop-in position and the pop-out position along a straight moving route L3. The straight moving route L3 may be arranged, for example, between the first center line L1 and the second center line L2. No other component may be arranged on the moving route of the first cleaning pad assembly 31. Accordingly, a space occupied by the movement of the first cleaning pad assembly 31 may need to be minimized. According to the cleaning robot of the disclosure, as the first cleaning pad assembly 31 moves along the straight moving route L3, the space occupied by the movement of the first cleaning pad assembly 31 may be minimized. In this manner, the degree of freedom in arrangement of components constituting the cleaning robot may be increased, and the mechanism for movement of the first cleaning pad assembly 31 may be simplified.

According to an embodiment of the disclosure, the cleaning robot may further include a second cleaning pad assembly 32 provided at the bottom portion of the main body 1. The second cleaning pad assembly 32 may be arranged in front of a pair of driving wheels 21 and 22. The second cleaning pad assembly 32 may include a cleaning pad (second cleaning pad) 32*c* and a holder (second holder) 32*b* supporting the cleaning pad 32*c*. The cleaning pad 32*c* may be a circular fabric pad, for example, a circular fabric with fur, etc. The second cleaning pad 32 may be rotated around a rotation shaft (second rotation shaft) 32*a*. The second cleaning pad assembly 32 may wipe the floor of the interior space while rotating around the rotation shaft 32*a*. A structure rotating the second cleaning pad assembly 32 may be identical to the structure rotating the first cleaning pad assembly 31. The second cleaning pad assembly 32 may have a fixed position. For example, the first cleaning pad assembly 31 and the second cleaning pad assembly 32 arranged symmetrically with respect to the second center line L2 perpendicular to the first center line L1. The second center line L2 may be a line crossing the center CC of the cleaning robot. When the first cleaning pad assembly 31 is in the pop-in position, the second cleaning pad assembly 32 be arranged symmetrically with the first cleaning pad assembly 31 with respect to the second center line L2. Such configuration may facilitate stable driving of the cleaning robot. When the first cleaning pad assembly 31 is in the pop-out position, as the cleaning robot generally drives along obstacles, asymmetry between the first cleaning pad assembly 31 and the second cleaning pad assembly 32 may not significantly affect the straight driving of the cleaning robot.

With reference to FIGS. 2 and 4, the cleaning robot according to an embodiment of the disclosure may further include a front roller 4. The front roller 4 may be arranged at the bottom portion of the main body 1. The front roller 4 may be arranged in front of the pair of driving wheels 21 and 22. The front roller 4 may be arranged in front of the first center line L1. The front roller 4 may be arranged as far as possible from the pair of driving wheels 21 and 22. The front roller 4 may be arranged on the second center line L2. As the front roller 4 is arranged in a shape of an isosceles triangle together with the pair of driving wheels 21 and 22, the front roller 4 may stably support the front portion of the main body 1 with respect to the floor of the interior space. The front roller 4 may be arranged adjacent to the first cleaning pad assembly 31. The front roller 4 may be arranged between the first cleaning pad assembly 31 and the second cleaning pad assembly 32.

The front roller 4 may support the front portion of the main body 1 with respect to the floor of the interior space. In a structure in which the first cleaning pad assembly 31 and/or the second cleaning pad assembly 32 support the weight of the main body 1 with respect to the floor of the interior space, a relatively high load may be applied to a motor configured to rotate the first cleaning pad assembly 31 and/or the second cleaning pad assembly 32. According to an embodiment of the cleaning robot of the disclosure, as the front portion of the main body 1 is supported by the front roller 4 with respect to the floor of the interior space, the load applied to the motor configured to rotate the first cleaning pad assembly 31 and/or the second cleaning pad assembly 32 may be reduced. Accordingly, the reliability of the cleaning robot may be increased, and the effect of reduction of power consumption by the motor configured to rotate the first cleaning pad assembly 31 and/or the second cleaning pad assembly 32 may be achieved.

With reference to FIGS. 2 and 4, the cleaning robot according to an embodiment of the disclosure may further include a rear roller 5. The rear roller 5 may be arranged at the bottom portion of the main body 1. The rear roller 5 may be arranged at the rear of the pair of driving wheels 21 and 22. The rear roller 5 may be arranged at the rear of first center line L1. The rear roller 5 may be arranged as far as possible from the pair of driving wheels 21 and 22. The rear roller 5 may be arranged on the second center line L2. As the rear roller 5 is arranged in a shape of an isosceles triangle together with the pair of driving wheels 21 and 22, the rear roller 5 may stably support the rear portion of the main body 1 with respect to the floor of the interior space. The rear roller 5 may be, for example, a caster.

With reference to FIGS. 2 and 4, according to an embodiment of the disclosure, the cleaning robot may further include at least one fall prevention sensor 7 configured to sense a floor. The fall prevention sensor 7 may sense existence of floor and a groove recessed from the floor, etc. by irradiating light onto the floor and receiving reflected light. The cleaning robot may detect a groove, a step difference, etc. based on a detection signal of the fall prevention sensor 7 and perform an avoidance (evasion) operation. The fall prevention sensor 7 may be arranged in front of the pair of driving wheels 21 and 22 to prevent falling of the pair of driving wheels 21 and 22 into a groove, a step difference, etc. The fall prevention sensor 7 may be arranged at a plurality of positions. The cleaning robot of the disclosure may include six fall prevention sensors 7 including two fall prevention sensors 7 arranged near the front roller 4 and four fall prevention sensors 7 arranged adjacent to each of the pair of driving wheels 21 and 22. However, the number of fall prevention sensor 7 is not limited thereto, and more fall prevention sensors 7 may be arranged at proper positions.

With reference to FIGS. 2 and 4, the cleaning robot according to an embodiment of the disclosure may further include a rear cleaning pad 6. The rear cleaning pad 6 may be provided at the bottom portion of the main body 1, and wipe the floor of the interior space at a fixed position. The rear cleaning pad 6 may be arranged at the rear of the pair of driving wheels 21 and 22. The rear cleaning pad 6 may be arranged at the rear of first center line L1. The rear cleaning pad 6 may be arranged between the pair of driving wheels 21 and 22 and the rear roller 5. The rear cleaning pad 6 may be a fabric, for example, a fabric with fur, etc. For example, the rear cleaning pad 6 may wipe the floor of the interior space one more time after the first cleaning pad assembly 31 and the second cleaning pad assembly 32. Thus, the cleaning effect may be enhanced.

In an embodiment of the disclosure, the cleaning robot may be a wet cleaning robot. The cleaning pad 31*c* of the first cleaning pad assembly 31 and the cleaning pad 32*c* of the second cleaning pad 32 may be wet cleaning pads. The rear cleaning pad 6 may be a dry pad. The rear cleaning pad 6 remove remaining water on the floor of the interior space after the cleaning is performed by the first cleaning pad assembly 31 and the second cleaning pad 32.

FIG. 5 is a schematic plan view of the cleaning robot according to an embodiment of the disclosure and illustrates a state in which an upper housing of the main body 1 is removed. As described above, the cleaning pad 31*c* of the first cleaning pad assembly 31 and the cleaning pad 32*c* of the second cleaning pad 32 may be wet cleaning pads. With reference to FIG. 5, according to an embodiment of the disclosure, the cleaning robot may further include a water tank 8 storing water to be supplied to the first cleaning pad assembly 31 and the second cleaning pad 32. The water tank 8 may be arranged at the center portion of the main body 1. For example, the water tank 8 may be arranged between the pair of driving wheels 21 and 22. The water tank 8 may be arranged at the rear of the first cleaning pad assembly 31 and the second cleaning pad 32. The water accommodated in the water tank 8 may be supplied to the first cleaning pad assembly 31 and the second cleaning pad 32 by a pump (not shown). For example, a water supply pipe 81 may be branched into a first water supply pipe 82 and a second water supply pipe 83. End portions of each of the first water supply pipe 82 and the second water supply pipe 83 may be arranged adjacent to the first cleaning pad 31*c* and the second cleaning pad 32*c*, respectively. The pump (not shown) may supply water in the water tank 8 to the first cleaning pad 31*c* and the second cleaning pad 32*c* through the water supply pipe 81, the first water supply pipe 82, and the second water supply pipe 83. Although it is not shown in the drawings, a sensor configured to sense an amount of remaining water in the water tank 8. When the sensor senses the amount of remaining water accommodated in the water tank 8 is less than or equal to a reference amount, a lack of residual water sign may be output on a user interface (not shown). The upper housing may be separated from the main body 1 to supplement water in the water tank 8 and then be mounted back onto the main body 1 or the water tank 8 may be separated from the main body 1 to supplement water and then mounted back onto the main body 1.

Figure 6:
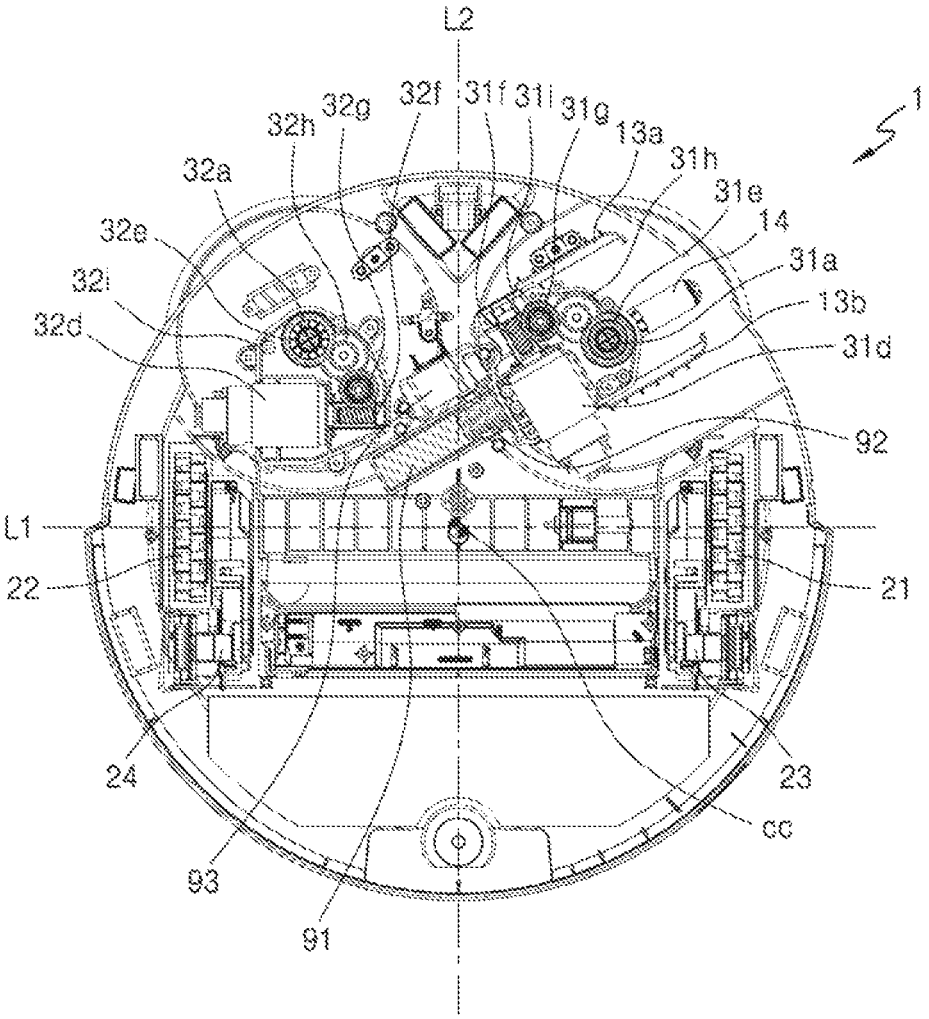
FIG. 6 is a schematic plan view of an embodiment of a structure rotating a first cleaning pad assembly.

FIG. 6 is a schematic plan view of an embodiment of a structure rotating the first cleaning pad assembly 31. With reference to FIGS. 3 and 6, the structure rotating the first cleaning pad assembly 31 may include a first motor 31*d*. For example, the rotation shaft 31*a* may be connected to the holder 31*b* supporting the cleaning pad 31*c* or extend from the holder 31*b*. The first motor 31*d* may be connected to the rotation shaft 31*a* by at least one power transmission member to rotate the rotation shaft 31*a*. For example, the rotation shaft 31*a* may be coupled to a gear 31*e*. A worm gear 31*f* may be coupled to a rotation shaft of the first motor 31*d*. The worm gear 31*f* may be engaged with a pinion 31*g*. The pinion 31*g* may be connected to the gear 31*e*, with a speed reduction gear 31*h* arranged therebetween. According to such configuration, the first cleaning pad assembly 31 may be rotated around the rotation shaft 31*a* by driving the first motor 31*d*.

A structure rotating the second cleaning pad assembly 32 may be identical to the structure rotating the first cleaning pad assembly 31. For example, the rotation shaft 32*a* may be connected to the holder supporting the cleaning pad 32*c* or extend from the holder. A motor 32*d* may be connected to the rotation shaft 32*a* by at least one power transmission member to rotate the rotation shaft 32*a*. For example, the rotation shaft 32*a* may be coupled to a gear 32*e*. A worm gear 32*f* may be coupled to a rotation shaft of the motor 32*d*. The worm gear 32*f* may be engaged with a pinion 32*g*. The pinion 32*g* may be connected to the gear 32*e*, with a speed reduction gear 32*h* arranged therebetween. According to such configuration, the second cleaning pad assembly 32 may be rotated around the rotation shaft 32*a* by driving the motor 32*d*. The second cleaning pad assembly 32 may be placed at a fixed position. The motor 32*d* including the worm gear 32*f*, the gear 32*e*, the pinion 32*g*, and the speed reduction gear 32*h* may be arranged in a frame 32*i*, and the frame 32*i* may be fixed to the main body 1.

Figure 7:
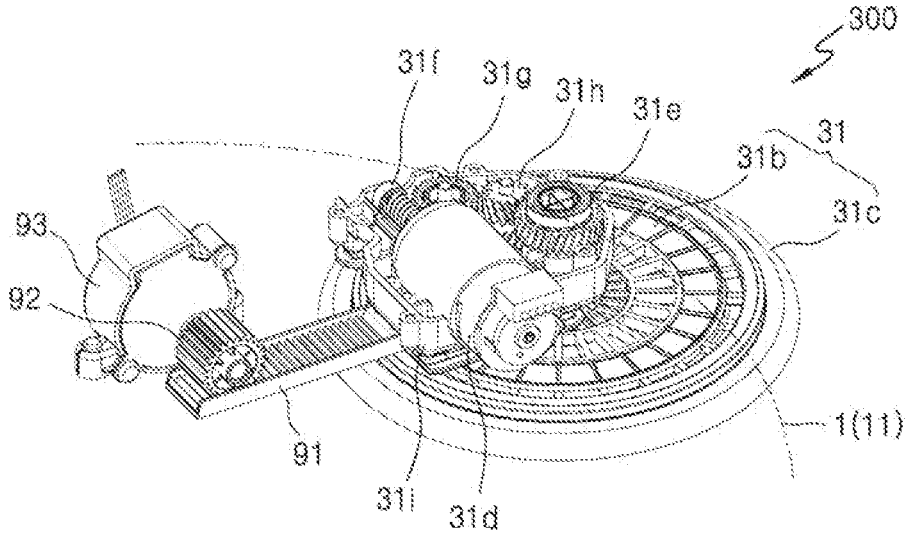
FIG. 7 is a perspective view of an embodiment of a structure moving a first cleaning pad assembly to a pop-in position and a pop-out position and illustrates a state in which the first cleaning pad assembly is placed in the pop-out position.
Figure 8:
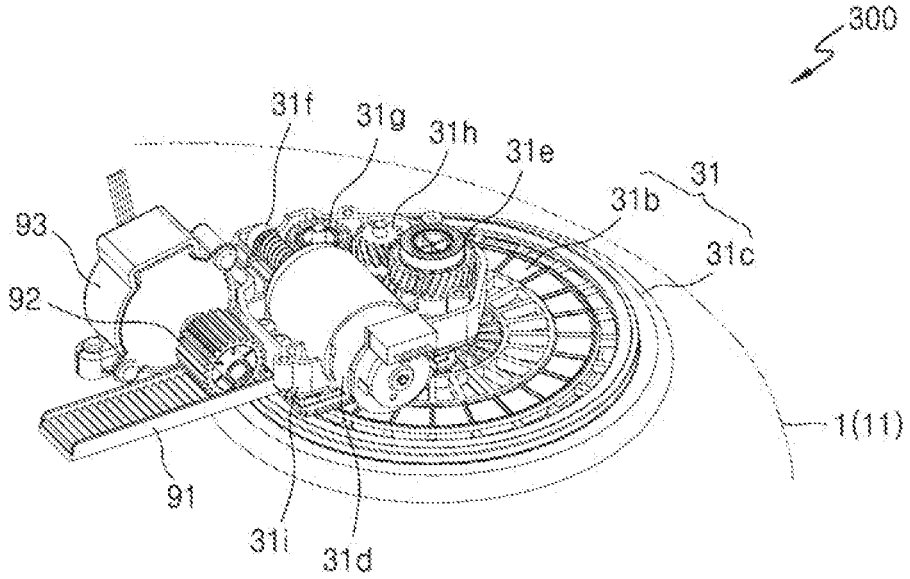
FIG. 8 is a perspective view of an embodiment of a structure moving a first cleaning pad assembly to a pop-in position and a pop-out position and illustrates a state in which the first cleaning pad assembly is placed in the pop-in position.

FIGS. 7 and 8 are perspective views of embodiments of structures moving the first cleaning pad assembly 31 to the pop-out position and the pop-in position, respectively. FIG. 7 illustrates the first cleaning pad assembly 31 placed at the pop-out position, and FIG. 8 illustrates the first cleaning pad assembly 31 placed at the pop-in position. With reference to FIGS. 6 to 8, the first motor 31*d* may be moved to the pop-in position and the pop-out position along with the first cleaning pad assembly 31. According to such configuration, even when the first cleaning pad assembly 31 is moved to the pop-in position and the pop-in position, a relative position of the first motor 31*d* and the first cleaning pad assembly 31 may not be changed. Accordingly, the power connection structure connecting the first motor 31*d* to the first cleaning pad assembly 31 may be simplified.

With reference to FIG. 6, a movable cleaning portion 300 may include the first cleaning pad assembly 31, a frame 31*i*, and the first motor 31*d*. The first cleaning pad assembly 31 may be supported rotatably by the frame 31*i*. For example, the holder 31*b* supporting the cleaning pad 31*c* may be arranged rotatably in the frame 31*i*. The first motor 31*d* including the worm gear 31*f*, the gear 31*e*, the pinion 31*g*, and the speed reduction gear 31*h* may be arranged in the frame 31*i*, and the frame 31*i* may be movably supported by the main body 1. The frame 31*i* may be supported by the main body 1, allowing straight movement of the first cleaning pad assembly 31 to the pop-in position in which the first cleaning pad assembly 31 is placed inside the main body 1, and to the pop-out position in which the first cleaning pad assembly 31 partially protrudes from the exterior portion 11 of the main body 1. For example, the main body 1 may include a pair of rails (i.e., rails 13*a* and 13*b*) extending along the straight moving route L3 (FIG. 4). The frame 31*i* may be supported in a slidable manner along the pair of rails 13*a* and 13*b*. An opening 14 opened along the straight moving route L3 may be provided at the main body 1, for example, the lower housing. The rotation shaft 32*a* may be inserted into the main body 1 from the lower portion of the main body 1 through the opening 14 and rotatably supported by the frame 31*i*.

An embodiment of a structure moving the movable cleaning portion 300 to the pop-in position and to the pop-in position along the movable cleaning portion 300 is described below. With reference to FIGS. 6 to 8, an embodiment of the structure moving the movable cleaning portion 300 may include a rack gear 91, a pinion 92 engaged with the rack gear 91, and a second motor 93 rotating the pinion 92. The rack gear 91 may extend from the frame 31*i*. The rack gear 91 may extend from the frame 31*i* along the straight moving route L3. The second motor 93 may be arranged at the main body 1, for example, the lower housing. By forward/reverse-rotating the second motor 93, the movable cleaning portion 300 may be moved in a straight line to the pop-in position (FIG. 8) and to the pop-out position (FIG. 7).

Figure 9:
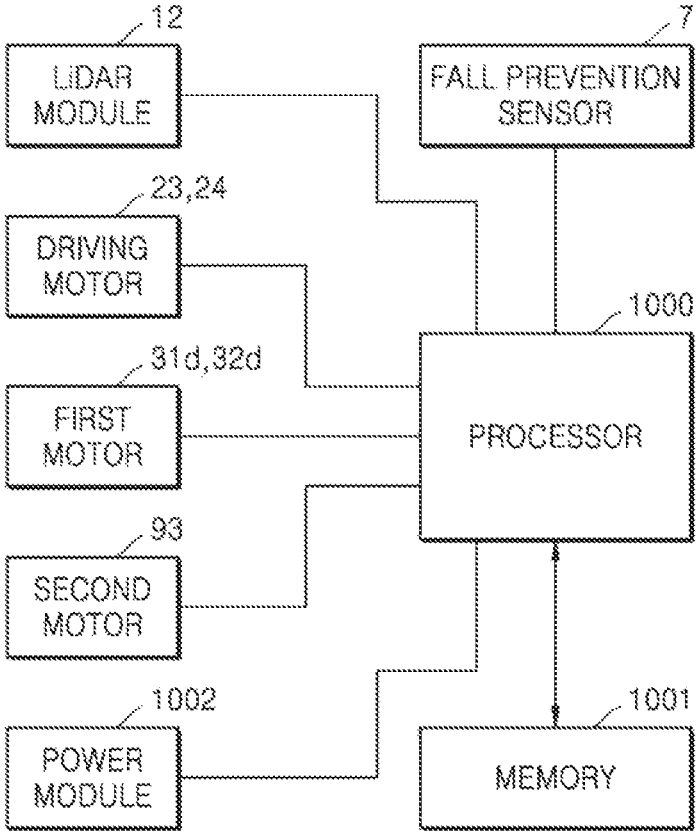
FIG. 9 is a schematic block diagram of an embodiment of a cleaning robot.

FIG. 9 is a schematic block diagram of an embodiment of a cleaning robot. With reference to FIG. 9, the cleaning robot may include a processor 1000 and a memory 1001. Although it is not shown in the drawings, the cleaning robot may further include a power module 1002. The power module 1002 may supply power to driving motors 23 and 24, the first motor 31*d* and the motor 32*d* rotating the first cleaning pad assembly 31 and the second cleaning pad assembly 32, the second motor 93 moving the first cleaning pad assembly 31, the motor rotating the LiDAR module 12, the pump supplying water to the first cleaning pad assembly 31 and the second cleaning pad assembly 32, an input/output module (not shown), various sensors including the fall prevention sensor 7, etc. The power module 1002 may include a battery, a power drive circuit, a converter, and a transformer circuit. Although it is not shown in the drawings, a charging terminal connected to a docking station to charge the battery may be provided at the main body 1.

The LiDAR module 12 may be a rotatable sensor configured to output laser and obtain geographic information including at least one of a distance, a position, a direction, or a material of an object from which the output laser is reflected. The LiDAR module 12 may obtain geographic information within, for example, a 6 m radius from a current position. The LiDAR module 12 may provide the obtained geographic information to the processor 1000.

The processor 1000 may execute one or more instructions of a program stored in the memory 1001. The processor 1000 include hardware components performing arithmetic, logic, and input/output operations and signal processing. The processor 1000 may include at least one of a central processing unit (CPU), a microprocessor, a graphic processing unit (GPU), application specific integrated circuits (ASICs), digital signal processors (DSPs), digital signal processing devices (DSPDs), programmable logic devices (PLDs), or field programmable gate arrays (FPGAs); however, the disclosure is not limited thereto. FIG. 9 illustrates the processor 1000 as one element; however, the disclosure is not limited thereto. In an embodiment of the disclosure, the processor 1000 may be constituted by one or more elements. In an embodiment of the disclosure, the processor 1000 may include an artificial intelligence (AI) processor configured to perform AI learning. In this case, the AI processor recognize a type of an object or an obstacle that exists in the interior space by using a learning network model of an AI system. The AI processor may be manufactured in the form of a dedicated hardware chip for AI, or manufactured as a part of an existing generic-purpose processor (e.g., CPU or application processor) or a graphics exclusive processor (e.g., graphics processing unit) and embedded in a cleaning robot 100.

Instructions for generating a map of the interior space may be stored in the memory 1001. In an embodiment of the disclosure, instructions and program codes which are readable by the processor 1000 may be stored in the memory 1001. The memory 1001 may include at least one storage medium from a flash memory type storage medium, hard disk type storage medium, multimedia card micro type storage medium, card type memory (e.g., SD or XD memory, etc.), random access memory (RAM), static RAM (SRAM), read-only memory (ROM), electrically erasable programmable ROM (EEPROM), programmable ROM (PROM), or an optical disk. In an embodiment of the disclosure, the cleaning robot may operate a web storage or a cloud server which is accessible via a network and performs the storage function. The processor 1000 may execute the instructions or program codes stored in the memory 1001.

The processor 1000 may explore the interior space based on a first position, which is the current position of the cleaning robot, by using the LiDAR module 12. The processor 1000 may obtain from the LiDAR module 12 geographic information about an empty space, a wall, an object, or a distance, a position, and a direction of an obstacle sensed in the interior space. In an embodiment of the disclosure, the processor 1000 may obtain information about obstacles existing in the interior space, e.g., a projection, furniture, home appliances, companion animals, etc. from a proximity sensor (not shown). The processor 1000 may obtain a map of the interior space by using sensing information obtained by using the LiDAR module 12 and the proximity sensor. The processor 1000 may use the simultaneous localization and mapping (SLAM) technology to identify a position of the cleaning robot on a map, set a movement target of the cleaning robot, and control the cleaning robot to perform cleaning.

The processor 1000 may control the driving motors 23 and 24 based on the map to drive the pair of driving wheels 21 and 22, and further, to drive the cleaning robot. The processor 1000 may control the driving motors 23 and 24 based on the map to drive the cleaning robot without collision with an obstacle. When a groove, step difference, etc. are detected based on the detection signal of the fall prevention sensor 7, the processor 1000 may control the driving motors 23 and 24 to avoid such groove, step difference, etc. When the cleaning robot is driving in a space without any obstacle, the processor 1000 may control, based on the map, the second motor 93 to place the first cleaning pad assembly 31 in the pop-in position. When the cleaning robot approaches an obstacle, such as a wall, etc., the processor 1000 may control, based on the map, the second motor 93 to place the first cleaning pad assembly 31 in the pop-out position. According to the foregoing, a floor adjacent to obstacles, such as walls, etc. may be effectively cleaned.

A cleaning robot according to an embodiment of the disclosure may include a main body having an exterior portion extending along a perimeter of the main body; wheels that are drivable to move the cleaning robot on a surface to be cleaned; a first rotation shaft; and a first holder coupled to the first rotation shaft and configured to support a first cleaning pad, wherein the first rotation shaft and the first holder are configured so that, when the cleaning robot is on the surface to be cleaned and the first cleaning pad is supported by the first holder: the first rotation shaft is rotatable along a rotation axis that is perpendicular to the surface to be cleaned to cause the first holder to rotate and thereby rotate the first cleaning pad to clean the surface, and the first rotation shaft is laterally movable in a direction perpendicular to the rotation axis to: a pop-in position in which the first rotation shaft and the first holder are under the main body and not protruding beyond the exterior portion of the main body, and a pop-out position in which the first rotation shaft is nder the main body and not protruding beyond the exterior portion and the first holder is partially under the main body and partially protruding beyond the exterior portion of the main body.

According to an embodiment the exterior portion of the main body can have a circular shape.

According to an embodiment the cleaning robot can include: a first motor configured to rotate the first rotation shaft, wherein the first motor is laterally movable, and in both the pop-in position and the pop-out position, the first motor is under the main body and not protruding beyond the exterior portion of the main body.

According to an embodiment the cleaning robot can include: a second rotation shaft; and a second holder coupled to the second rotation shaft and configured to support a second cleaning pad, wherein the second rotation shaft and the second holder are configured so that, when the cleaning robot is on the surface to be cleaned and the second cleaning pad is supported by the second holder, the second rotation shaft is rotatable along a rotation axis that is perpendicular to the surface to be cleaned to cause the second holder to rotate and thereby rotate the second cleaning pad to clean the surface.

According to an embodiment the wheels can include a pair of driving wheels in which the wheels of the pair of the driving wheels are parallel to one another on a first center line of the main body, and the first holder and the second holder are symmetric with respect to a second center line perpendicular to the first center line.

According to an embodiment the cleaning robot can include a front roller in front of the pair of driving wheels.

According to an embodiment the front roller can be on the second center line perpendicular to the first center line.

According to an embodiment the front roller can be adjacent to the first holder.

According to an embodiment the cleaning robot can include a rear wheel to the rear of the wheels.

According to an embodiment the cleaning robot can include a rear holder configured to support a rear cleaning pad to the rear of the wheels.

According to an embodiment the wheels can include a pair of wheels and the cleaning robot can include: a water tank between the wheels of the pair of wheels and configured to store water to be supplied to the first cleaning pad when the first cleaning pad is supported by the first holder.

According to an embodiment the first holder can be movable to the pop-in position and the pop-out position along a straight moving route.

According to an embodiment the cleaning robot can include: a frame supported by the main body and configured to rotatably support the first holder to allow the first holder to move to the pop-in position and the pop-out position; a rack gear extending from the frame; a pinion gear engaged with the rack gear; and a second motor configured to rotate the pinion gear.

According to an embodiment the cleaning robot can include at least one fall prevention sensor in front of the wheels and configured to sense the surface.

A cleaning robot according to an embodiment of the disclosure may include: a main body including an exterior portion of a circular shape; a pair of driving wheels on a first center line at a bottom portion of the main body; a movable cleaning portion in front of the pair of driving wheels and including: a first holder configured to support a first cleaning pad, a frame rotatably supporting the first holder, a first motor configured to rotate the first holder and first cleaning pad, and a second holder configured to support a second cleaning pad and being symmetrical with the first holder with respect to a second center line perpendicular to the first center line, wherein the frame is supported by the main body to allow a straight movement of the first holder to: a pop-in position in which the first holder is under the main body and not protruding beyond the exterior portion of the main body, and a pop-out position in which the first holder is partially under the main body and partially protruding beyond the exterior portion of the main body.

According to an embodiment the cleaning robot can include a front roller on the second center line between the first holder and the second holder.

According to an embodiment the cleaning robot can include a rear wheel on the second center line at a rear of the first center line.

According to an embodiment the cleaning robot can include a rear holder between the first center line and the rear wheel, and configured to support a rear cleaning pad.

According to an embodiment the cleaning robot can include a water tank between driving wheels of the pair driving wheels and configured to store water to be supplied to the first cleaning pad.

According to an embodiment the cleaning robot can include a rack gear extending from the frame; a pinion gear engaged with the rack gear; and a second motor coupled to the main body and configured to rotate the pinion gear. According to the aforementioned embodiment of the disclosure, the cleaning robot may drive effectively and stably.

It should be noted that the term "under the main body" should be understood as referring to below an upper surface of main body when looking down at the cleaning robot from a top-view perspective while the cleaning robot is on the floor. For example, in the pop-in and pop-out position the rotation shaft can be at least partially within the main body and still be under the main body because it is below an upper surface of the main body.

While embodiments of the disclosure have been particularly shown and described with reference to the accompanying drawings, various modifications and changes may be made from the descriptions by one of skill in the art. For example, proper results may be achieved even when the operations described above may be performed differently from the described order, and/or the aforementioned components, such as computer systems, modules, etc. are coupled or combined in other forms, replaced or substituted with other components or equivalents.

The invention claimed is:

1. A cleaning robot comprising:

a main body having an exterior portion extending along a perimeter of the main body;

wheels that are drivable to move the cleaning robot on a surface to be cleaned;

a first rotation shaft;

a first motor configured to rotate the first rotation shaft;

a first holder coupled to the first rotation shaft and configured to support a first cleaning pad; and a frame, supported by the main body so as to be slidable in a straight movement, and supporting the first motor and the first holder, wherein the first rotation shaft, the first motor, the first holder, and the frame are configured such that, when the cleaning robot is on the surface to be cleaned and the first cleaning pad is supported by the first holder:

the first rotation shaft is rotatable by the first motor along a first rotation axis that is perpendicular to the surface to be cleaned to cause the first holder to rotate and thereby rotate the first cleaning pad to clean the surface, and the first rotation shaft is laterally movable in a direction perpendicular to the first rotation axis, and the frame is slidable in the straight movement in the direction perpendicular to the first rotation axis, to:

a pop-in position in which the first rotation shaft and the first motor are under the main body and not protruding beyond the exterior portion of the main body, and a pop-out position in which the first rotation shaft and the first motor are under the main body and not protruding beyond the exterior portion of the main body and the first holder is partially under the main body and partially protruding beyond the exterior portion of the main body.

2. The cleaning robot of claim 1, wherein the exterior portion of the main body has a circular shape.

3. The cleaning robot of claim 1, further comprising:

a second rotation shaft; and a second holder coupled to the second rotation shaft and configured to support a second cleaning pad, wherein the second rotation shaft and the second holder are configured such that, when the cleaning robot is on the surface to be cleaned and the second cleaning pad is supported by the second holder, the second rotation shaft is rotatable along a second rotation axis that is perpendicular to the surface to be cleaned to cause the second holder to rotate and thereby rotate the second cleaning pad to clean the surface.

4. The cleaning robot of claim 3, wherein:

the wheels comprise a pair of driving wheels in which the wheels of the pair of the driving wheels are parallel to one another on a first center line of the main body, and the first holder and the second holder are symmetric with respect to a second center line perpendicular to the first center line.

5. The cleaning robot of claim 4, further comprising:

a front roller in front of the pair of driving wheels.

6. The cleaning robot of claim 5, wherein the front roller is on the second center line perpendicular to the first center line.

7. The cleaning robot of claim 5, wherein the front roller is adjacent to the first holder.

8. The cleaning robot of claim 1, further comprising:

a rear wheel to a rear of the wheels.

9. The cleaning robot of claim 8, further comprising:

a rear cleaning pad to the rear of the wheels.

10. The cleaning robot of claim 1, wherein the wheels include a pair of wheels, and the cleaning robot further comprising:

a water tank between the wheels of the pair of wheels and configured to store water to be supplied to the first cleaning pad when the first cleaning pad is supported by the first holder.

11. The cleaning robot of claim 1, wherein the first holder is movable to the pop-in position and the pop-out position along a straight moving route.

12. The cleaning robot of claim 11, further comprising:

a rack gear extending from the frame;

a pinion gear engaged with the rack gear; and a second motor configured to rotate the pinion gear.

13. The cleaning robot of claim 1, further comprising:

at least one fall prevention sensor in front of the wheels and configured to sense the surface.

14. A cleaning robot comprising:

a main body including an exterior portion of a circular shape;

a pair of driving wheels on a first center line at a bottom portion of the main body;

a movable cleaning portion in front of the pair of driving wheels and including:

a first holder configured to support a first cleaning pad, a frame rotatably supporting the first holder, and a first motor supported by the frame and configured to rotate the first holder; and a second holder configured to support a second cleaning pad and being symmetrical with the first holder with respect to a second center line perpendicular to the first center line, wherein the frame is supported by the main body so as to be slidable in a straight movement to allow a straight movement of the first holder and the first motor to:

a pop-in position in which the first motor is under the main body and not protruding beyond the exterior portion of the main body, and a pop-out position in which the first holder is partially protruding beyond the exterior portion of the main body from the pop-in position and the first motor is under the main body and not protruding beyond the exterior portion of the main body.

15. The cleaning robot of claim 14, further comprising:

a front roller on the second center line between the first holder and the second holder.

16. The cleaning robot of claim 14, further comprising:

a rear wheel on the second center line at a rear of the first center line.

17. The cleaning robot of claim 16, further comprising:

a rear cleaning pad between the first center line and the rear wheel.

18. The cleaning robot of claim 14, further comprising:

a water tank between driving wheels of the pair of driving wheels and configured to store water to be supplied to the first cleaning pad.

19. The cleaning robot of claim 14, further comprising:

a rack gear extending from the frame;

a pinion gear engaged with the rack gear; and a second motor.

* * * * *